US005683234A

United States Patent [19]

Chuang et al.

[11] Patent Number: 5,683,234

[45] Date of Patent: Nov. 4, 1997

[54] HAND PUMP APPARATUS HAVING TWO PUMPING STROKES AND HAVING AN ATTACHMENT MEMBER FOR ENGAGING WITH DIFFERENT TIRE VALVES

[76] Inventors: Louis Chuang, 7th Floor-8, No. 20, Ta Lon Road, Taichung; Scott Wu, No. 2, Lane 296, Ming Sheng Road, Wufeng Hsiang, Taichung Hsien, both of Taiwan

[21] Appl. No.: 746,864

[22] Filed: Nov. 18, 1996

[51] Int. Cl.[6] ..... F04B 53/10

[52] U.S. Cl. ..... 417/531; 417/526; 417/510; 417/534; 137/223; 251/352; 251/258

[58] Field of Search ..... 417/437, 515, 417/516, 555.1, 510, 526, 531, 534; 92/162 R, 162 P; 137/59, 223; 251/352, 258

[56] References Cited

U.S. PATENT DOCUMENTS

| | | | |
|---|---|---|---|
| 1,789,306 | 1/1931 | Ewald | 137/223 |
| 1,838,166 | 12/1931 | Wahl | 137/223 |
| 1,860,888 | 5/1932 | Crowley | 137/223 |
| 1,918,689 | 7/1933 | Crowley | 137/223 |
| 2,441,253 | 5/1948 | Sarver | 251/258 |
| 2,442,631 | 6/1948 | Winkler | 417/526 |
| 2,847,028 | 8/1958 | Ross | 137/867 |
| 3,572,384 | 3/1971 | Taylor | 137/625.5 |
| 5,441,080 | 8/1995 | Baumann | 251/258 |
| 5,449,278 | 9/1995 | Lin | 417/526 |
| 5,531,575 | 7/1996 | Lin | 417/526 |
| 5,551,848 | 9/1996 | Chuang et al. | 417/437 |

FOREIGN PATENT DOCUMENTS

| | | | |
|---|---|---|---|
| 532760 | 1/1941 | United Kingdom | 137/223 |
| 548165 | 9/1942 | United Kingdom | 137/223 |
| 548787 | 10/1942 | United Kingdom | 137/223 |

OTHER PUBLICATIONS

U.S. Patent Application Serial Number 08/553,854, filed Nov. 6, 1995 and allowed Mar. 20, 1997.

*Primary Examiner*—Timothy Thorpe
*Assistant Examiner*—Peter G. Korytnyk
*Attorney, Agent, or Firm*—Charles E. Baxley, Esq.

[57] ABSTRACT

A hand pump includes a piston slidably engaged in a housing for separating the housing into two chambers. A tube is secured on top of the housing. The piston includes two annular grooves for receiving two sealing rings. A piston rod has one end secured to the piston and has the other end extended outward of the housing. The piston may pump the air in upper chamber into the tube when the piston moves upward, and the air in the lower chamber may be pumped into the tube when the piston moves downward. The tube includes two mouths for engaging with different tire valves.

1 Claim, 6 Drawing Sheets

HAND PUMP APPARATUS HAVING TWO PUMPING STROKES AND HAVING AN ATTACHMENT MEMBER FOR ENGAGING WITH DIFFERENT TIRE VALVES

BACKGROUND OF THE INVENTION

1. Field of the Invention

The present invention relates to a hand pump apparatus, and more particularly to a hand pump apparatus having two pumping strokes and having an attachment member for pumping different tire valves.

2. Description of the Prior Art

Typical hand pumps comprise a cylindrical member having a piston slidably engaged therein and having a piston rod secured to the piston for moving the piston in a reciprocating action within the cylindrical member for pumping air. However, normally, the air may be pumped only when the piston is pushed forward of the cylindrical member. The piston may not pump air when moving rearward. In addition, the hand pumps each includes an attachment member that is good for engaging with a specific type of tire valve and which is not suitable for engaging with different tire valves. In order to pump two different tire valves, it is required to prepare two hand pumps having different attachment members for engaging with the different tire valves.

The present invention has arisen to mitigate and/or obviate the afore-described disadvantages of the conventional hand pumps.

SUMMARY OF THE INVENTION

The primary objective of the present invention is to provide a hand pump apparatus which may pump air when the piston moves either forward or rearward of the cylindrical member.

The other objective of the present invention is to provide a hand pump which includes an attachment member for engaging with different tire valves.

In accordance with one aspect of the invention, there is provided a hand pump apparatus comprising a housing including an interior and including a conduit formed beside the housing, the housing including an upper chamber and a lower chamber, the conduit including an upper portion communicating with the upper chamber and including a lower portion communicating with the lower chamber, a piston slidably engaged in the interior of the housing so as to separate the housing into the upper chamber and the lower chamber, the piston including a upper annular groove and a lower annular groove formed therein so as to define an upper ring and a middle ring and a lower ring, the piston including an aperture formed in the middle ring and communicating with the annular grooves, the upper ring and the lower ring each including a cut off portion formed therein for communicating the annular grooves with the upper chamber and the lower chamber respectively, a first sealing ring and a second sealing ring engaged in and movable in the upper annular groove and the lower annular groove respectively, a piston rod slidably engaging in the lower portion of the housing and including a first end secured to the piston, the piston rod including an interior having an upper portion communicating with the aperture of the piston, the piston rod including a second end extended outward of the housing, a tube secured on top of the housing and including a bore, and including a middle portion having an aperture intersecting with the bore, the tube including two end portions and including two valve seats formed therein, two caps secured to the end portions of the tube and each including an mouth for engaging with tire valves, a cam shaft rotatably engaged in the tube and including a passageway, a pair of gaskets engaged in the end portions of the tube, a valve member slidably engaged in the tube so as to form an annular chamber between the valve member and the tube, the valve member being engaged between the gaskets, the valve member including two ends each having a head portion for engaging with the valve seats of the tube respectively, the valve member including a middle portion having an orifice for engaging with the cam shaft, the passageway of the cam shaft being communicating with the orifice, the ends of the valve member including two valve openings. The head portions of the valve member is forced to engage with the valve seats respectively by the cam shaft for enclosing one of the head portions and for opening the other valve seat and and for allowing air to flow through the mouth. The first sealing ring is engaged with the middle ring of the piston for making an air tight seal between the housing and the piston when the piston moves upward and for pumping the air received in the upper chamber into the tube, air is allowed to flow into the lower chamber via the interior of the piston rod, and the second sealing ring is engaged with the middle ring of the piston for making an air tight seal between the housing and the piston when the piston moves downward, for pumping the air received in the lower chamber into the tube.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
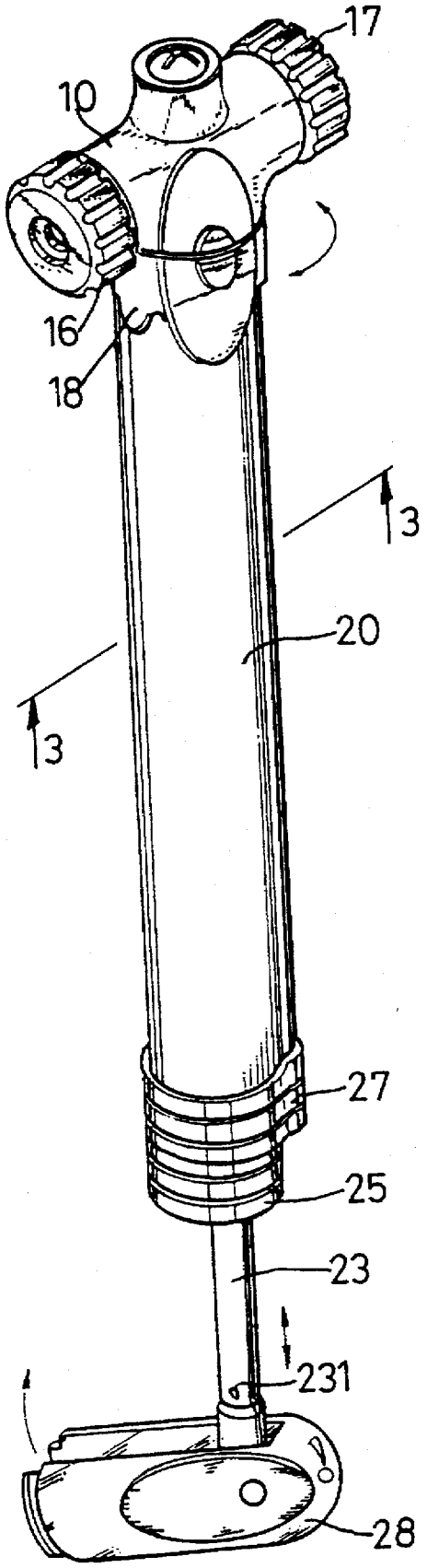
FIG. 1 is a perspective view of a hand pump in accordance with the present invention.
Figure 2:
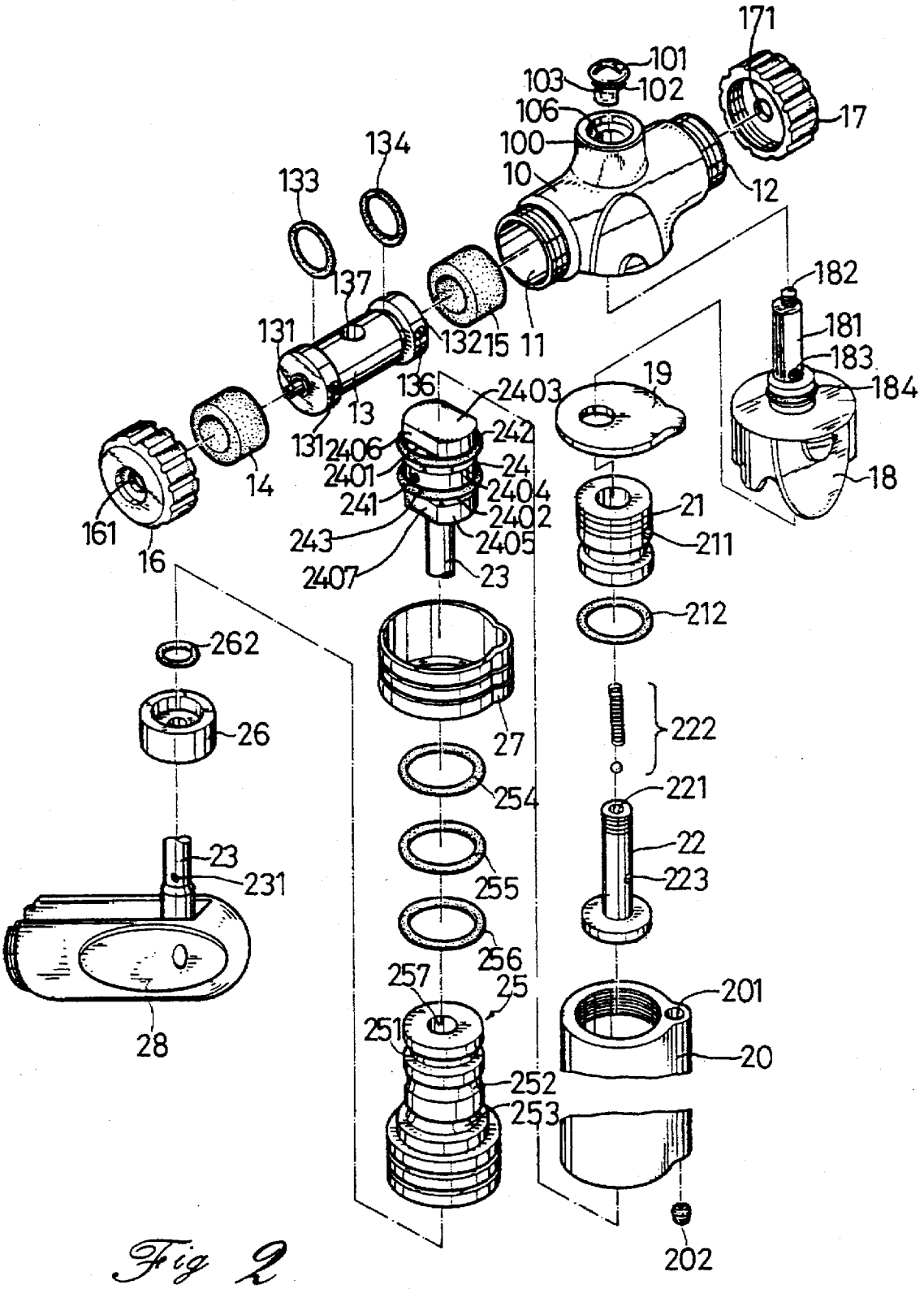
FIG. 2 is an exploded view of the hand pump.
Figure 3:
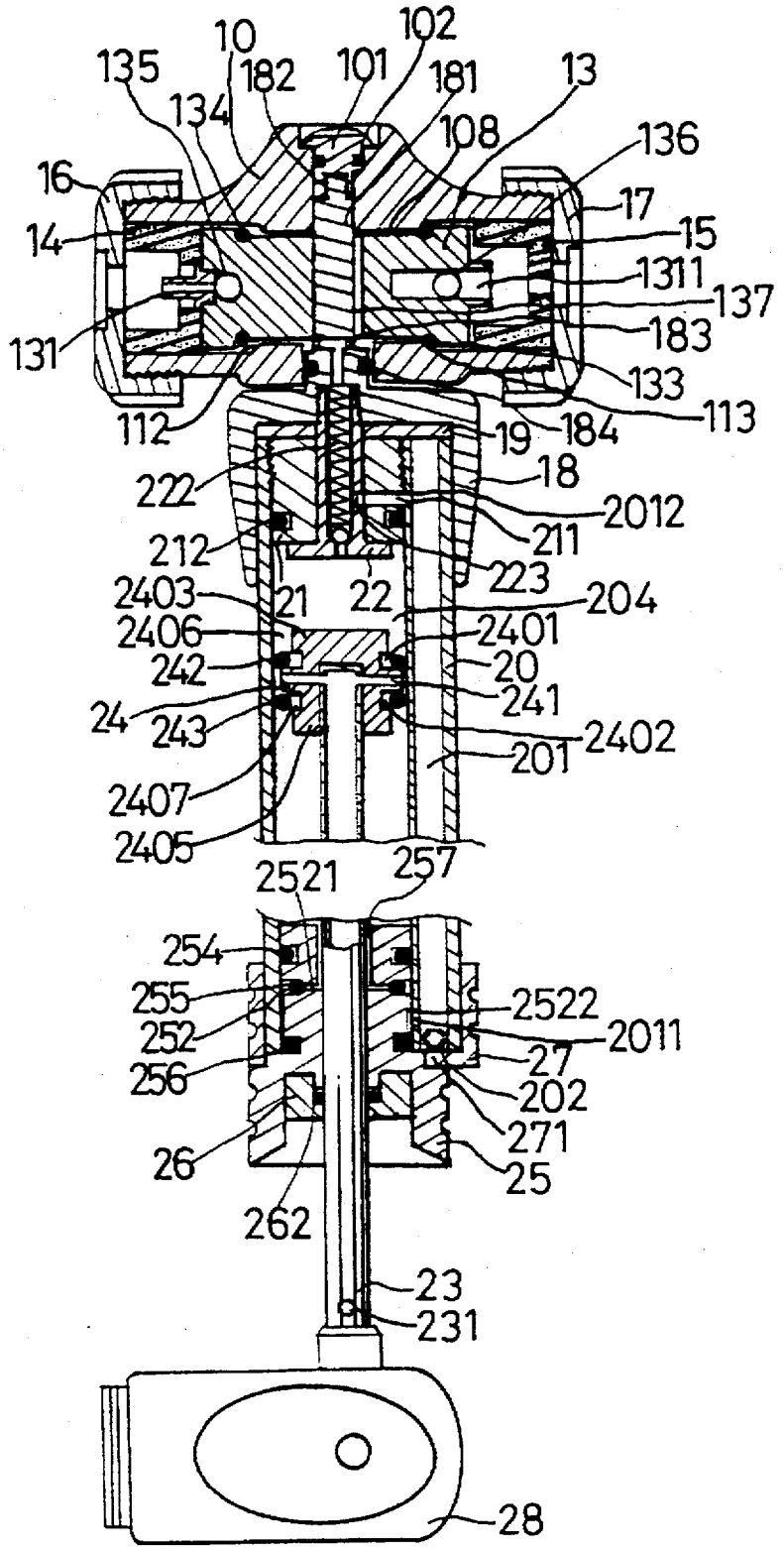
FIGS. 3, 4, 5 and 6 are cross sectional views taken along lines 3—3 of FIG. 1.

Referring to the drawings, and initially to FIGS. 1 to 3, a hand pump apparatus in accordance with the present invention comprises a housing 20 including an interior for slidably receiving a piston 24 therein which separates the interior of the housing 20 into two chambers 204, 205. A conduit 201 is formed beside the housing 20 and includes a lower hole 2011 and an upper hole 2012 for communicating with the chambers 205, 204 of the housing 20 respectively. A valve member 202 is disposed in the bottom of the conduit 201. The piston 24 includes two annular grooves 2401, 2402 formed therein so as to define an upper ring 2403, a middle ring 2404 and a lower ring 2405. Two sealing rings 242, 243 are engaged in the annular grooves 2401, 2402 respectively and each has a size smaller than that of the annular grooves 2401, 2402 such that the sealing rings 242, 243 may move either upward or downward relative the annular grooves 2401, 2401. The piston 24 includes an aperture 241 formed in the middle tins 2404 and communicating with the annular grooves 2401, 2402. The upper fine 2403 and the lower ring 2405 each includes at least one cut off portion 2406, 2407 for communicating the chambers 204, 205 with the annular grooves 2401, 2402. A piston rod 23 is slidably engaged in the lower portion of the housing 20 and includes an upper end secured to the piston 24. The piston rod 23 includes an interior having an upper portion communicating with the aperture 241 of the piston 24 and includes a handle 28 secured to the bottom end and includes an opening 231 formed in the lower end for communicating the interior of the piston rod 23 with the environment.

Figures 4, 7:
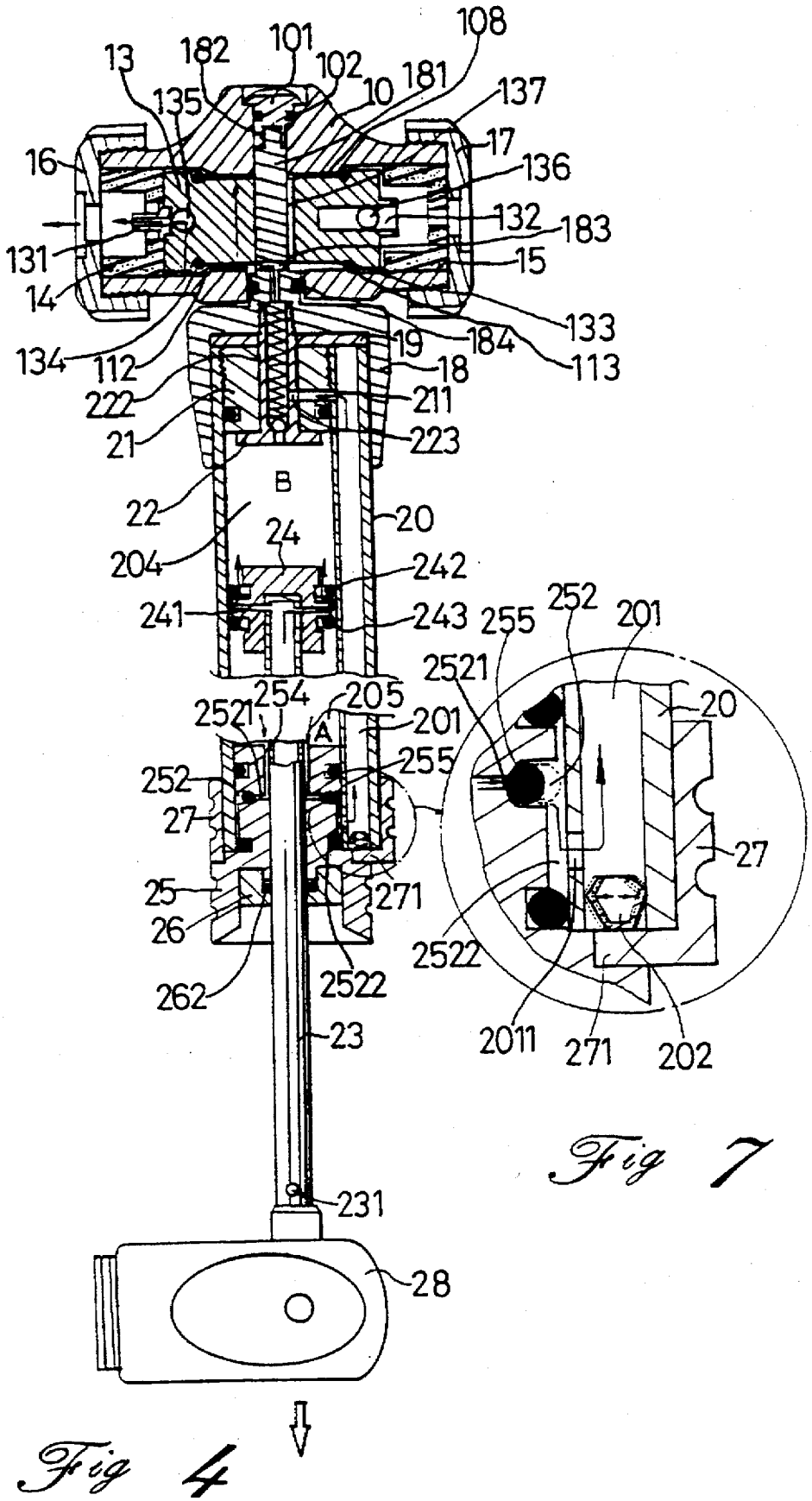
FIG. 7 is an enlarged partial cross sectional view of the hand pump.

A lid 25 and a cover 27 are secured to the bottom end of the housing 20. The lid 25 includes a bore 257 and includes three annular grooves 251, 252, 253 formed in the outer peripheral portion for engaging with three sealing rings 254, 255, 256 respectively. The lid 25 includes a puncture 2521 communicating with the annular groove 252 and with the gap 2522 formed between the lid 25 and the inner peripheral surface of the lower portion of the housing 20 (FIGS. 4 and 7). A plug 26 is secured to the bottom end of the lid 25 and a sealing ring 262 is engaged between the plug 26 and the piston rod 23 and the lid 25 so as to make an air tight seal therebetween. A bolt 22 is engaged in the upper portion of the housing 20 and includes a bore 221 for receiving a check valve 222 therein which includes a spring and a ball. The bolt 22 includes a hole 223. A sleeve 21 is engaged on the bolt 22 and includes a sealing ring 212 engaged between the sleeve 21 and the housing 20 for making an air tight seal between the sleeve 21 and the housing 20. The sleeve 21 includes a hole 211 for communicating with the hole 223 of the bolt 22 and the upper hole 2012 of the conduit 201. A board 19 is secured on the upper portion of the housing 20. and a cover 18 is secured on top of the housing 20 and secured to the bolt 22. The cover 18 including a cam shaft 181 extended upward therefrom and having a sealing ring 184 engaged thereon for making an air tight seal between the cover 18 and a tube 10. The cam shaft 181 includes a T-shaped air passageway 183 formed therein and communicating with the tube 10 and with the bore 221 of the bolt 22. The cam shaft 181 is arranged eccentrically relative to the tube 10 and the cover 18.

A tube 10 includes a stud 100 extended upward therefrom so as to form a T-shaped configuration. The tube 10 includes an aperture 106 vertically formed in the middle portion and extended in the stud 100 and intersecting with the bore 11 of the tube 10. The cam shaft 181 is rotatably engaged in the aperture 106. A screw 101 is engaged in the upper portion of the aperture 106 and includes a sealing ring 102 for making an air tight seal between the screw 101 and the stud 100. The screw 101 includes a screw hole 103 for engaging with the screw 182 of the cam shaft 181 so as to secure the cam shaft 181 to the tube 10. The tube 10 includes two ends each having an outer thread 12 formed thereon for engaging with inner threads of two caps 16, 17 respectively such that the caps 16, 17 may be secured to the end portions of the tube 10. The caps 16, 17 each includes a mouth 161, 171 formed therein for engaging with tire valves. The bore 11 of the tube 10 may slidably receive a valve member 43 and two gaskets 14, 15 therein and includes two valve seats 112, 113 (FIG. 3) formed therein.

The valve member 13 includes two enlarged head portions 132 formed in the end portions for engaging with the valve seats 112, 113 of the tube 10 and includes two annular grooves formed beside the enlarged head portions 132 for engaging with the sealing rings 133, 134 respectively. Either of the sealing rings 133, 134 may be forced to engage with the valve seats 112, 113 so as to block the air passages to the mouths 161, 171 of the caps 16, 17 when either of the enlarged head portions 132 of the valve member 13 is forced toward the respective valve seats 112, 113. The valve member 13 includes an orifice 137 aligned with the aperture 106 of the tube 10 for receiving the cam shaft 181, and arranged such that the valve member 13 may be forced to move longitudinally in the tube 10 when the cam shaft 181 is rotated relative to the tube 10. A nozzle 131 is engaged in one of the head portions 132 for engaging with Japanese or French type tire valves. The other head portion 132 includes a valve opening 1311 formed therein for engaging with American type tire valves.

It is to be noted that the sizes of the head portions 132 is slightly smaller than the inner size of the bore 11 of the tube 10 such that air may flow through the head portions 132 when the sealing rings 133, 134 are not engaged with the respective valve seats 112, 113. The head portions 132 each includes a passage 135, 136 formed therein for communicating the nozzle 131 and the valve opening 1311 with the annular chamber 108 (FIGS. 3–6) which is formed between the outer peripheral portion of the valve member 13 and the tube 10.

In operation, as shown in FIG. 3, when the piston rod 23 is pushed upward of the housing 20, the sealing rings 242, 243 may engage with the middle ring 2404 and the lower ring 2405 respectively. At this moment, an air tight seal is formed between the housing 20 and the middle ring 2404 such that the air received in the upper chamber 204 may be pumped into the bore 11 of the tube 10 via the check valve 222 and the passageway 183. Simultaneously, when the piston 24 moves forward, the sealing ring 243 is engaged with the lower ring 2405. However, the annular groove 2402 may be communicated with the lower chamber 205 via the cut off portion 2407 such that the air may flow into the lower chamber 205 via the opening 231 and the hollow interior of the piston rod 23, the aperture 241, the annular groove 2402 and the cut off portion 2407.

Figure 5:
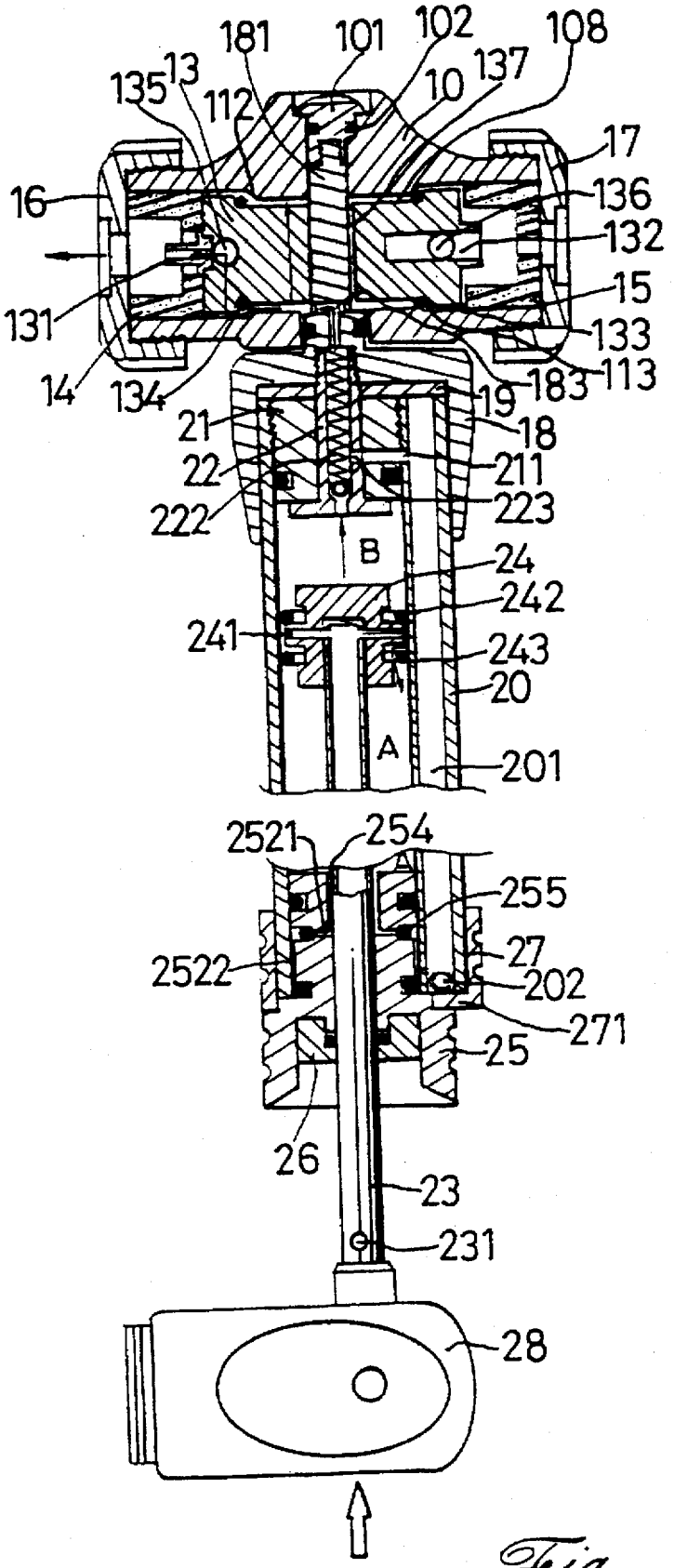

As shown in FIG. 4, when the piston rod 23 is moved downward of the housing 20, the sealing rings 242, 243 may engage with the upper ring 2403 and the middle ring 2404 respectively. At this moment, an air tight seal is formed between the housing 20 and the middle ring 2404 for enclosing the annular groove 2402 such that the air received in the lower chamber 205 may be pumped into the bore 11 of the tube 10 via the puncture 2521, the gap 2522, the lower hole 2011 of the conduit 201, the conduit 201, the upper hole 2012 of the conduit 201, the hole 211 of the sleeve 21, the hole 223 of the bolt 22 and the check valve 222. Simultaneously, when the piston 24 moves downward, the sealing ring 242 is engaged with the upper ring 2403. However, the annular groove 2401 may be communicated with the upper chamber 204 via the cut off portion 2406 such that the air may flow into the upper chamber 204 via the opening 231 and the interior of the piston rod 23, the aperture 241, the annular groove 2401 and the cut off portion 2406. The air received in the upper chamber 204 may be pumped out of the housing 20 when the piston 24 is moved upward again (FIG. 5).

Figure 6:
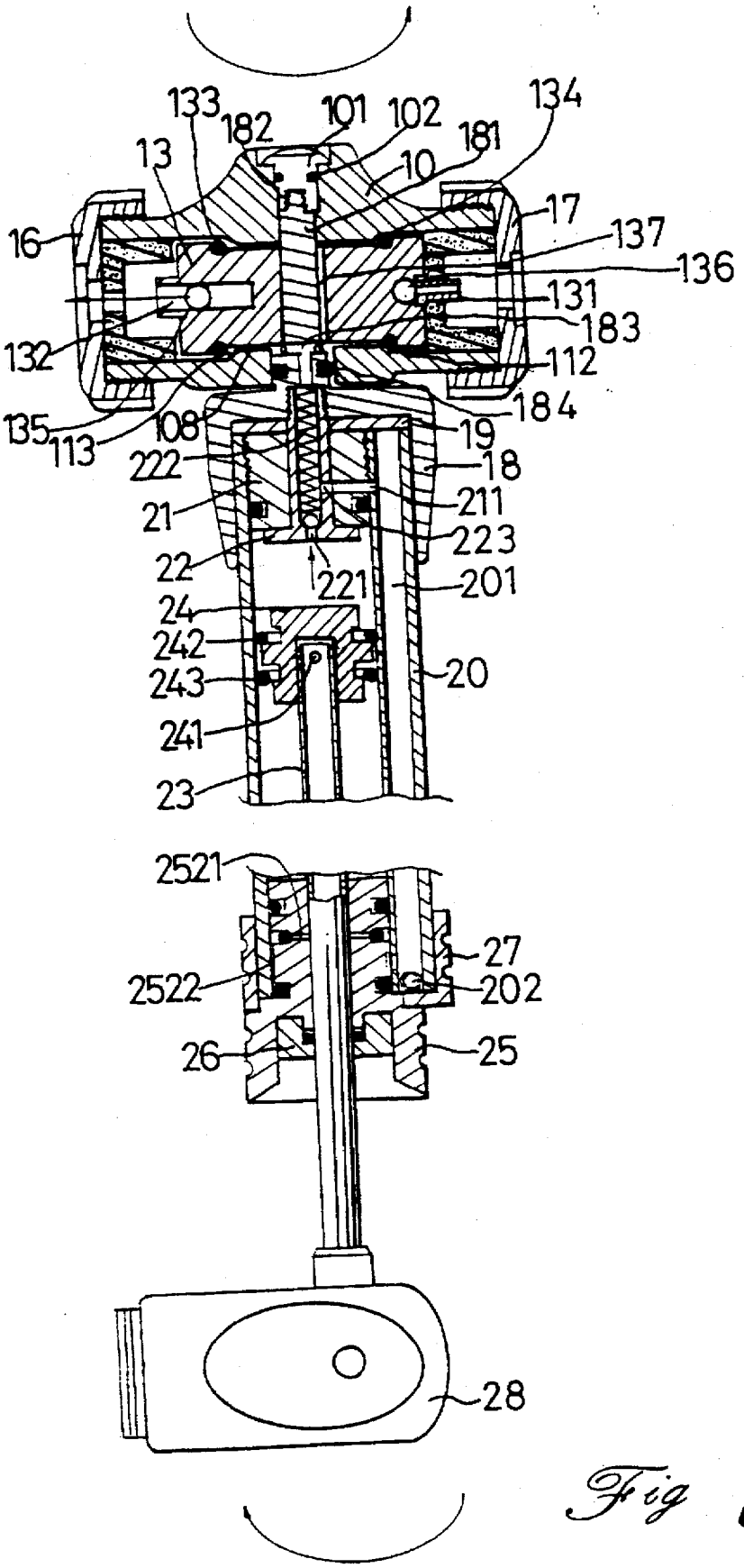

As shown in FIG. 6, either of the sealing rings 133, 134 may be forced to engage with the respective valve seat 112, 113 (FIG. 3) by the cam shaft 181 when the cam shaft 181 is rotated by the handle 28. When the valve seat 112 is opened (FIG. 3–6), the air from the passageway 183 of the cam shaft 181 is allowed to flow out of the nozzle 131 such that the hand pump may be provided for pumping a tire valve engaged in one end of the valve member. When the other valve seat 113 is opened, the air from the passageway 183 of the cam shaft 181 is allowed to flow out through the nozzle 131 such that the hand pump may be provided for pumping a tire valve engaged in the other end of the valve member.

Accordingly, the hand pump apparatus in accordance with the present invention includes a piston that may be provided for pumping air when the piston moves both forward and downward. In addition, the attachment member of the invention may be provided for engaging with different tire valves.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A hand pump apparatus comprising:

a housing including an interior and including a conduit formed beside said housing, said housing including an upper chamber and a lower chamber, said conduit including an upper portion communicating with said upper chamber and including a lower portion communicating with said lower chamber, a piston slidably engaged in said interior of said housing so as to separate said housing into said upper chamber and said lower chamber, said piston including a upper annular groove and a lower annular groove formed therein so as to define an upper ring and a middle ring and a lower ring, said piston including an aperture formed in said middle ring and communicating with said annular grooves, said upper ring and said lower ring each including a cut off portion formed therein for communicating said annular grooves with said upper chamber and said lower chamber respectively, a first sealing ring and a second sealing ring engaged in and movable in said upper annular groove and said lower annular groove respectively, a piston rod slidably engaging in said lower portion of said housing and including a first end secured to said piston, said piston rod including an interior having an upper portion communicating with said aperture of said piston, said piston rod including a second end extended outward of said housing, a tube secured on top of said housing and including a bore, and including a middle portion having an aperture intersecting with said bore, said tube including two end portions and including two valve seats formed therein, two caps secured to said end portions of said tube and each including an mouth for engaging with tire valves, a cam shaft rotatably engaged in said tube and including a passageway, a pair of gaskets engaged in said end portions of said tube, a valve member slidably engaged in said tube so as to form an annular chamber between said valve member and said tube, said valve member being engaged between said gaskets, said valve member including two ends each having a head portion for engaging with said valve seats of said tube respectively, said valve member including a middle portion having an orifice for engaging with said cam shaft, said passageway of said cam shaft being communicating with said orifice, said ends of said valve member including two valve openings, said head portions of said valve member being forced to engage with said valve seats respectively by said cam shaft for enclosing one of said head portions and for opening the other valve seat and and for allowing air to flow through said mouth, said first sealing ring being engaged with said middle ring of said piston for making an air tight seal between said housing and said piston when said piston moves upward and for pumping the air received in said upper chamber into said tube, air being allowed to flow into said lower chamber via said interior of said piston rod, and said second sealing ring being engaged with said middle ring of said piston for making an air tight seal between said housing and said piston when said piston moves downward, for pumping the air received in said lower chamber into said tube.

* * * * *